US007644449B2

(12) United States Patent
Hellweg

(10) Patent No.: US 7,644,449 B2
(45) Date of Patent: Jan. 12, 2010

(54) LOAD-BEARING EQUIPMENT

(75) Inventor: Albert Hellweg, Mitcham (AU)

(73) Assignee: Light Path Innovation Pty Ltd, Victoria (AU)

( * ) Notice: Subject to any disclaimer, the term of this patent is extended or adjusted under 35 U.S.C. 154(b) by 269 days.

(21) Appl. No.: 10/569,194

(22) PCT Filed: Aug. 20, 2004

(86) PCT No.: PCT/AU2004/001114

§ 371 (c)(1),
(2), (4) Date: Sep. 1, 2006

(87) PCT Pub. No.: WO2005/018355

PCT Pub. Date: Mar. 3, 2005

(65) Prior Publication Data

US 2007/0271674 A1 Nov. 29, 2007

(30) Foreign Application Priority Data

Aug. 21, 2003 (AU) ..... 2003904495

(51) Int. Cl.

| | |
|---|---|
| ***A41D 27/20*** | (2006.01) |
| ***A41D 1/00*** | (2006.01) |
| ***A41D 3/02*** | (2006.01) |
| ***A41D 1/04*** | (2006.01) |

(52) U.S. Cl. ..... 2/247; 2/94; 2/102

(58) Field of Classification Search ..... 2/69, 2/102, 101, 94, 312, 249, 251, 103, 2.5, 253, 2/100, 97, 266, 265, 247, 248, 321, 462; 24/3.1, 3.5, 72.7, 468, 306; 224/623, 625, 224/257, 930

See application file for complete search history.

(56) References Cited

U.S. PATENT DOCUMENTS

| | | | | |
|---|---|---|---|---|
| 4,106,121 | A | 8/1978 | Belson | |
| 5,201,448 | A * | 4/1993 | Schue | 224/675 |
| 5,278,998 | A | 1/1994 | Book | |
| 5,617,582 | A | 4/1997 | Burwell | |
| 5,724,707 | A * | 3/1998 | Kirk et al. | 24/3.7 |
| 5,988,315 | A * | 11/1999 | Crane | 182/3 |
| 6,397,392 | B1 | 6/2002 | Wooley et al. | |
| 7,200,871 | B1 * | 4/2007 | Carlson | 2/103 |
| 2005/0015943 | A1 * | 1/2005 | Wemmer | 24/580.1 |
| 2005/0015944 | A1 * | 1/2005 | Bergeron | 24/584.1 |

FOREIGN PATENT DOCUMENTS

| | | |
|---|---|---|
| CA | 1068240 | 12/1979 |
| FR | 2721179 | 6/1994 |
| WO | 97/48302 | 12/1997 |

OTHER PUBLICATIONS

European Search Report No. EP 04 76 1151.

* cited by examiner

*Primary Examiner*—Gary L Welch
*Assistant Examiner*—Amber R Anderson
(74) *Attorney, Agent, or Firm*—Dorsey & Whitney LLP

(57) ABSTRACT

A load-bearing system is provided which includes a web of sufficient strength to support predetermined loads suspended from the web. The system also includes an array of apertures in the web. The apertures can be elongate slots, and the array may be such that the slots can form plural pairs of slots which can define respective positions. At each of the positions, a pouch may be attached to the web via an attachment arrangement that can form a closed loop through the respective pair of slots.

46 Claims, 3 Drawing Sheets

LOAD-BEARING EQUIPMENT

CROSS-REFERENCE TO RELATED APPLICATIONS(S)

The present application is a national phase application of International Application No. PCT/AU2004/001114 filed on Aug. 20, 2004, and claims priority from such International application pursuant to 35 U.S.C. § 365. In addition, the present application claims priority from Australian Application No. 2003-904495 filed on Aug. 21, 2003. The entire disclosures of the above-identified International and Australian applications are incorporated herein by reference.

FIELD OF THE INVENTION

This invention relates generally to load-bearing equipment. In an advantageous application, the invention relates more particularly to the attachment of load-bearing pouches to personally worn or carried items such as garments, packs or the like. In a particularly useful application, the invention relates to a versatile load-bearing vest.

BACKGROUND OF THE INVENTION

Load-bearing vests are commonly worn as outer garments by police, emergency and military personnel who are required to carry a variety of items of equipment in an easily accessible location. Such items include water carriers, radios, batons, knives, handguns, ammunition, grenades and capsicum spray canisters. These items are usually carried in pouches attached to the vest.

Traditionally, the pouches are permanently fastened to the vests in fixed positions, eg. by being stitched into position. An example of a vest with stitched-on pouches for a variety of purposes is to be found in U.S. Pat. No. 5,617,582. Because the pouches are stitched in position, a police or military unit may require access to more than one different vest, perhaps several, each designed for a different operation.

In order to reduce the need for this enlarged inventory, there have been a number of proposals for vest systems in which the pouches are detachable and interchangeable, and the pouch array thereby reconfigurable. An early approach is disclosed in U.S. Pat. No. 4,106,121: the front panels of the vest have multiple pouch locations defined by velcro strips and snap fastener posts by which each pouch may be detachably fitted to the vest.

In a quite different arrangement, International Patent Publication WO 01/93710 describes a load carrying system including a panel of mesh which overlays the garment or pack. An array of holes complementary to the openings in the mesh is provided on the pouches. A stud-like fastener is used to secure each pouch to the panel by passing a shank through a registered pair of holes in the panel and in the pouch and using a keeper to secure the shank in place. The shank has a series of barbs or grooves to engage the keeper. Due to the array of holes provided by the mesh forming the panel, the pouches can be located at any of a variety of positions and moreover may be positioned at an angle to the vertical.

In a similar system that has been disclosed, instead of a panel of mesh overlaying the garment, the stud-like fasteners are employed to attach the pouches to the mesh openings in the vest itself: load-bearing vests are commonly of open-weave mesh construction to improve ventilation and minimize the vest's contribution to greater body heat.

Another reconfigurable system, adopted by some United States military personnel, has a vest with an attached array of vertical and horizontal webbing to which pouches are hooked by clips of a kind conventionally employed to fasten items to waist-belts.

An issue with the above described reconfigurable systems is the lack of reliability of the fastener arrangements. Where attachment is to mesh, the openings in the mesh are not stable and the fasteners tend to pull out through the holes. The fasteners are intended to be disengageable by hand, and so have a tendency to be too easily released when other forces are applied. This is unsatisfactory, for example, because personnel may be required to crawl along the ground or manoeuvre in situations where they would be brushing past objects. The fasteners are also considered too bulky, as they project from the garment. The stud-like fasteners have a small head and therefore create a localized pressure point, which is uncomfortable for the wearer.

It Is therefore an object of the invention, at least in a particular application, to provide a personal load-bearing system with a more reliable and durable pouch attachment system which is reconfigurable and comfortable for the user.

SUMMARY OF THE INVENTION

In a first aspect, the invention provides a load-bearing system having:

- a web of sufficient strength to support predetermined loads suspended from the web;
- a primary array of apertures in said web;
- a plurality of pouches having in their rear faces respective secondary arrays of apertures; and
- attachment means to attach each of said pouches to said web at one or more positions at each of which the attachment means forms a closed loop through respective pairs of apertures in the primary array and in the secondary array of the respective pouch.

In a second aspect, the invention provides a load-bearing component for a load-bearing system having:

- a web of sufficient strength to support predetermined loads suspended from the web; and
- an array of apertures in said web;
- wherein said apertures are elongate slots and said array is such that the slots form plural pairs of slots defining respective positions at each of which a pouch may be attached to the web by attachment means that forms a closed loop through respective pairs of slots in the web and in the pouch.

Advantageously, in either aspect of the invention, the load-bearing system is a personal load-bearing system, in which said web is of a form able to be worn or carried on the body of a person.

In one application, said web is in the form of a garment. More typically, said garment is a vest. Alternatively, said web is in the form of a pack, eg. a backpack. In a still further application, the web is a panel or plate, flexible or semi-flexible or rigid, adapted to be carried by a support surface. One such support surface might be on a vehicle. The panel or plate may be moulded, eg injection moulded, in a suitable material.

Advantageously, in the first aspect of the invention, said apertures are slots. In either aspect, the array of apertures comprises a multiplicity of parallel elongate slots, which preferably include subsets of aligned or co-linear slots. There may be plural sub-arrays of the slots in which the slots are respectively at different alignments, for example, in the case of a vest, horizontally, vertically and diagonally with respect to the orientation of the vest when being worn.

The apertures in the web are preferably of substantially stable dimensions and shape, and may have reinforced edges.

The vest is preferably a fabric, and the apertures thereon are preferably preformed during the manufacture of the fabric.

The attachment means is conveniently an elongate clip being a strip that either is preformed to define, or can be folded to define, two generally parallel overlaid arms that are integrally joined at one end and have fastener means for disengageably linking them at or adjacent the other end. In situ, the integral join and the fastener means traverse the respective pair of apertures in the arrays of apertures in the web and the pouch, whereby to form said closed loop.

The fastener means is preferably a snap-fastener, and is advantageously arranged for minimal protrusion outwardly of said strip forming the attachment means. Disengagement is preferably by use of a tool, so as to lessen the risk of accidental release.

In the first aspect of the invention, the secondary arrays of apertures in the respective pouches may be provided by a load-bearing system according to the second aspect of the invention, eg a system in the form of the aforementioned panel or plate.

The invention further provides, in a third aspect, a pouch component for a load-bearing system, including:

a pouch body; and a backing panel attached to the rear of the pouch body;

wherein the backing panel includes an array of elongate slots that form one or more pairs of slots defining respective positions at each of which the pouch may be attached to a complementary web by attachment means that forms a closed loop through respective pairs of slots in the backing panel and the web.

BRIEF DESCRIPTION OF THE DRAWINGS

The invention will now be further described, by way of example only, with reference to the accompanying drawings, in which.

EMBODIMENTS OF THE INVENTION

Figure 1:
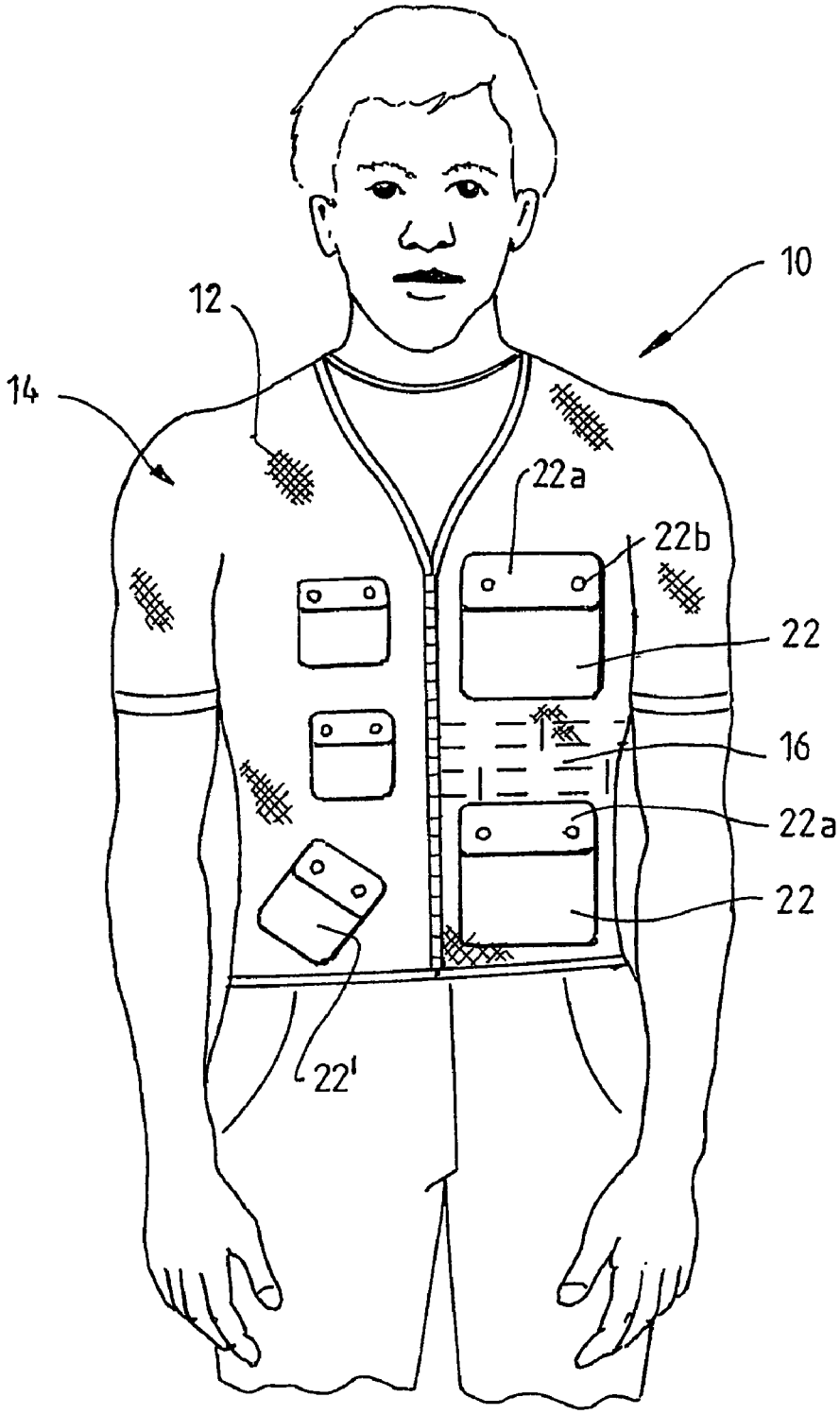
FIG. 1 is an illustration of a load-bearing system according to an embodiment of the present invention, being worn by a person.

FIG. 1 illustrates a load-bearing system 10 having a web 12 of fabric in the form of a vest 14, and a set of pouches 22 of variable size and purpose that are selectively and detachably engageable with the vest 14. Pouches 22 each have a pouch body and a closure flap 22*a* with releasable fasteners 22*b*. As is typical for load-bearing vests, web 12 is of open-weave mesh construction to improve ventilation and minimize the vest's contribution to greater body heat.

Figure 2:
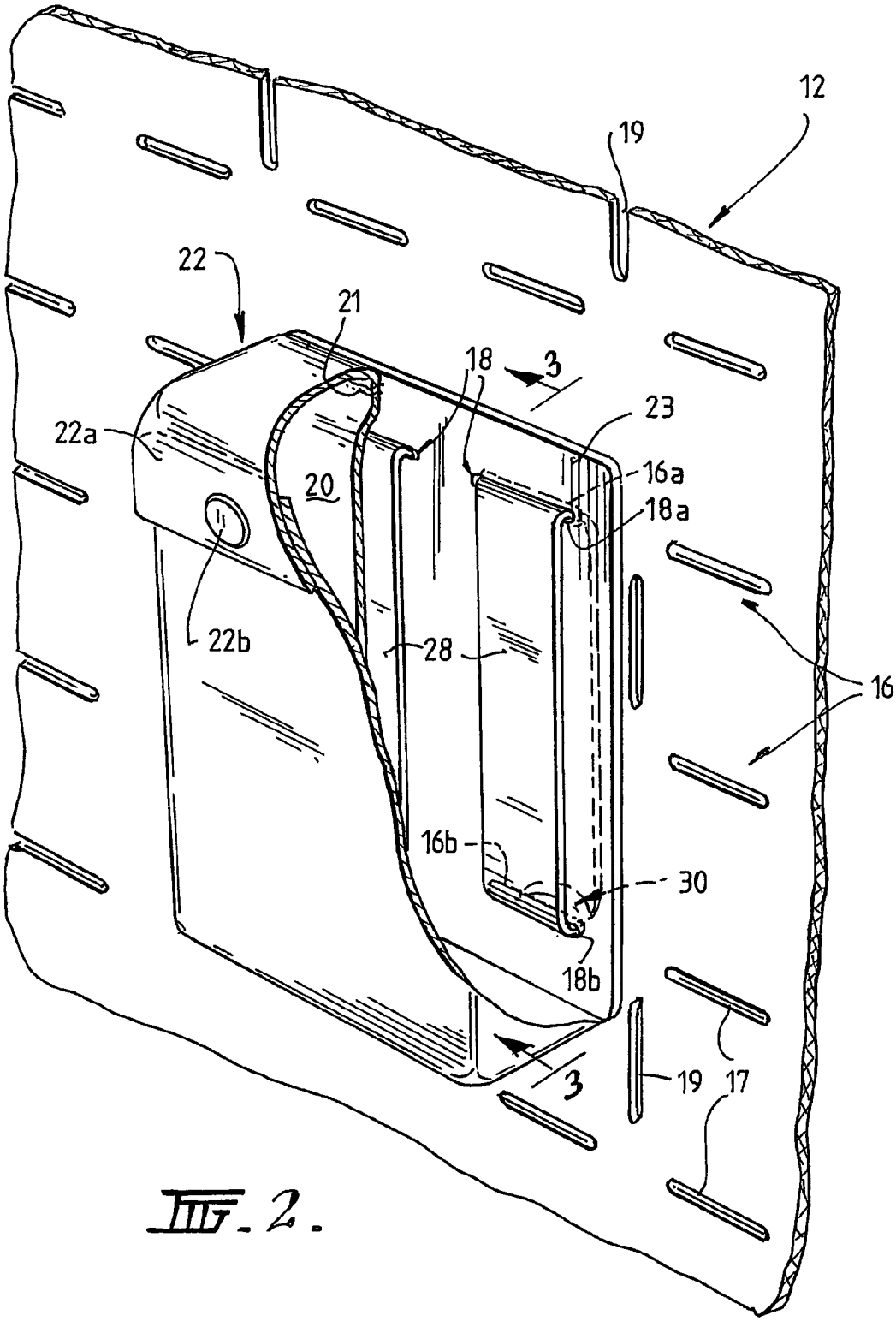
FIG. 2 is a fragmentary perspective view of a section of the load-bearing system of FIG. 1 with a part of a pouch cutaway.
Figure 3:
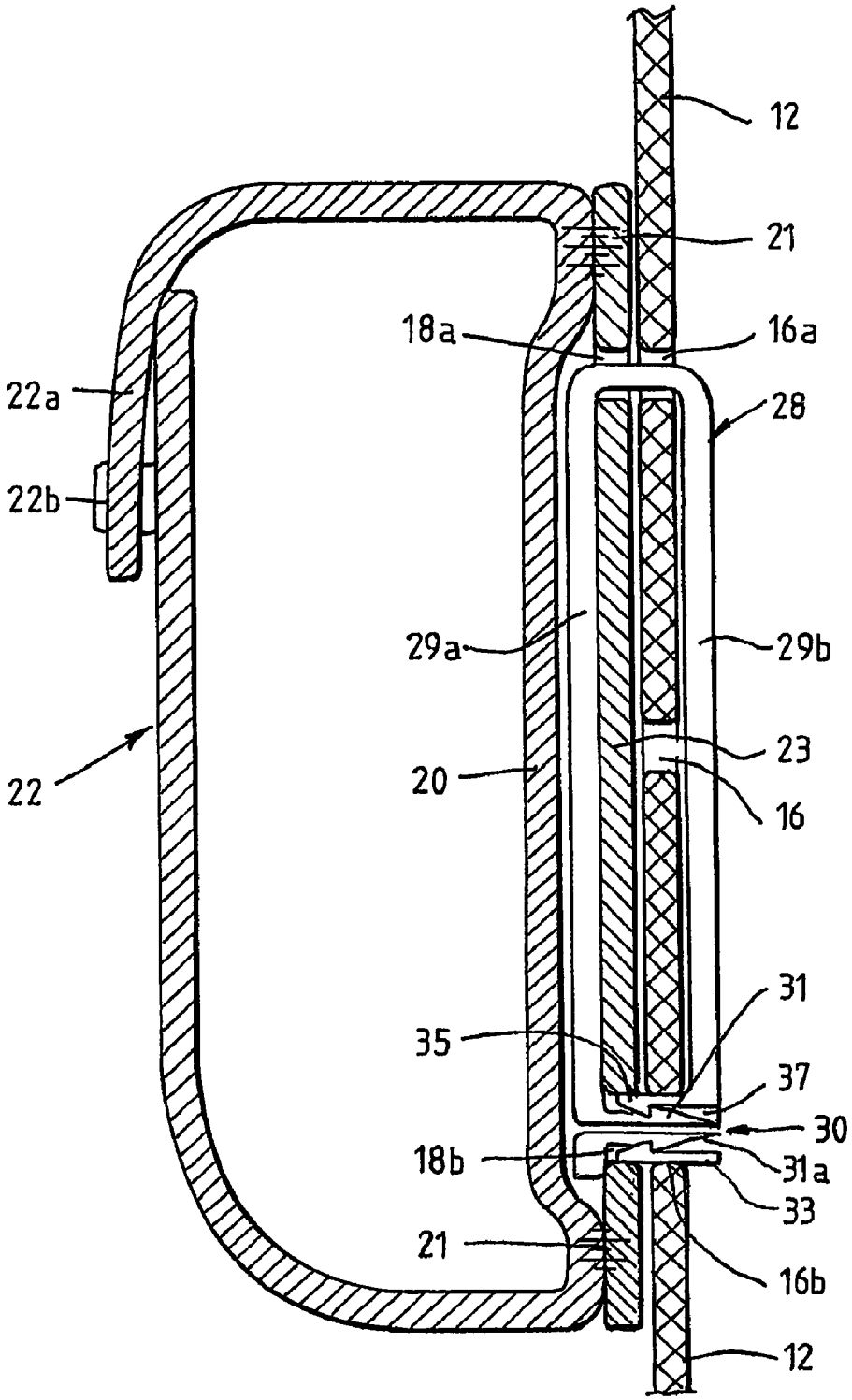
FIG. 3 is a not-to-scale cross-sectional view on the line 3-3 in FIG. 2, with some dimensions exaggerated for purposes of illustration.

The web 12 includes a primary array of apertures 16 in addition to the holes of the open-weave mesh. Pouches 22 have a backing panel 23, fixed to the rear face 20 of the pouch body, for example by stitching 21 about the periphery of the backing panel. The term "panel" does not typically indicate a rigid component: any suitable material of adequate strength will suffice. A complementary secondary array of apertures 18 is formed in backing panel 23 as best shown in FIGS. 2 and 3.

In this embodiment, the apertures 16, 18 are elongate slots, with the slots 16 in the web 12 being of similar dimensions to the slots 18 in the rear face of 20 of pouches 22. Conveniently, slots 16 and 18 may be at 50 mm centres. The slots may typically be 3 mm or more in width and 6 mm or more in length.

The primary array comprises a multiplicity of slots 16 arranged in respective sub-arrays 17, 19 of slots 16*a*, 16*b* (FIG. 2) in each of which the slots are parallel in aligned or co-linear subsets at uniform spacings. Adjacent parallel slots in successive lines are aligned perpendicular to the elongate dimension of the slots. Two sub-arrays 17, 19 are depicted in which the slots are at different alignments, in this case horizontally and vertically with respect to the orientation of the vest when being worn. The slots 18 of the secondary array are arranged to be complementary to one of the sub-arrays 17, 19, albeit on a much smaller scale, and at the same spacings or at a spacing that is an integral multiple of the slot spacings in the primary array.

Slots 16, 18 are preformed during weaving of the fabric of web 12, and are typically reinforced at or near their edges.

When a pouch 22 is required to be attached to vest 14, backing panel 23 is positioned against the web 12 so as to match and align a set of parallel slots 18*a*, 18*b* of the secondary array with a set of slots 16*a*, 16*b* in the web array. In the illustrated case, there is a 2:1 ratio between the slot spacings. An attachment means in the form of an elongate clip 28 is passed through the pair of adjacent slots 18*a*, 16*a* and is then secured in position by fastener means 30 through slots 18*b*, 16*b*. Clip 28 is a flat strip that either is preformed to define, or can be folded to define, two generally parallel overlaid arms 29*a*, 29*b* that are integrally joined at one end and have fastener means 30 adjacent the other end. Fastener means 30 is a snap fastener comprising a pair of resiliently deflectable barbed prongs 31 on one arm 29*a* and a complementary socket 33 to receive the prongs and latch them behind an internal shoulder 35.

It will be seen that, once snap fastener 30 is engaged, clip 28 forms a closed loop through the respective pairs of apertures 16*a*, 16*b*; 18*a*, 18*b* of the primary and secondary arrays.

Snap fastener 30 is able to be engaged by hand, but preferably a tool must be used to disengage prong 31 from socket 33 and so detach the clip from the vest. This reduces the chance of the clips 28 accidentally unlocking during use. The tool may be originally made integrally with fastener 30, joined by web portions, such that the tool may be snapped off from fastener 30 and carried by the wearer of the vest. A suitable tool might comprise a handle with a small tubular head able to fit into space 37 in socket 33 about the prong 31, for engaging the tapered external surface 31*a* of the prong and deforming it sufficiently to release the prong from shoulder 35.

Even if the snap fastener 30 of a clip 28 were to disengage, a level of security is provided in that the clip will remain, at least for some time, attached at the other of the apertures 16 through which it is placed. This gives time for the slack attachment to be noticed and the clip re-fastened.

As can be seen in FIG. 2, two clips 28 may typically be used to secure a pouch 22 to the web 12. For smaller pouches, one clip 28 may be sufficient and for larger pouches, or pouches for carrying greater loads, more than two clips 28 may be used.

As previously discussed, current systems use a stud-like fastener which is bulky and uncomfortable. Elongate clips 28 lie flat against the wearer's body and provide a secure, stable fixing at least two points, substantially without pouch rotation. Their elongate flat form avoids any localized pressure point, adding to the comfort of the wearer, and it will be further noted that the components of snap fastener 30 do not protrude outwardly of the strip of clip 28.

The pouch depicted in FIGS. 2 and 3 is shown attached to vest sub-array 17 having slots that are oriented generally horizontally. It will be understood that pouches might instead be attached to vertically aligned slots of sub-array 19. In another variation, there might be a sub-array of diagonally oriented slots: in FIG. 1, pouch $\mathbf{22}^{I}$ is shown attached to such slots. It is also emphasized that while apertures in the form of slots are advantageous, especially with clips of the kind illustrated, this is by no means critical. The apertures 16, 18 may be several round or square holes or any other shape and need not be elongate.

The illustrated embodiment is a load-bearing vest. It is emphasized that the invention has much wider application, eg to other garments, to backpacks and other load carriers, and more generally to any system adapted to be carried by a support surface. The system might be, eg a panel or plate, flexible, semi-flexible or rigid according to application. A particularly convenient further application of the invention is to a vehicle.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A load-bearing system comprising:

a web of open-weave mesh for enhancing ventilation having a sufficient strength so as to support at least one predetermined load suspended there-from;

a first array of apertures through the open-weave mesh in addition to holes in the open-weave mesh;

a plurality of pouches having respective second arrays of apertures in rear faces thereof; and an attachment arrangement configured to attach each of the pouches to the web at one or more positions, wherein at each of the positions, the rear face of the pouch is positioned against the web of open-weave mesh so as to horizontally match and align respective pairs of the apertures in the first array and in the respective second array, and the attachment arrangement forms a closed loop through the respective pairs of apertures.

2. The load-bearing system according to claim 1, wherein the apertures are slots.

3. The load-bearing system according to claim 2, wherein the system is a personal load-bearing system, in which the web is of a form that is capable of being worn or carried on a body of a person.

4. The load-bearing system according to claim 3, wherein the web has a form of a garment.

5. The load-bearing system according to claim 4, wherein the garment is a vest.

6. The load-bearing system according to claim 4, wherein the apertures are preformed during a manufacture of the garment.

7. The load-bearing system according to claim 2, wherein the array of apertures includes one or more subsets of parallel elongated slots.

8. The load-bearing system according to claim 7, wherein the parallel elongated slots include slots that are aligned or co-linear.

9. The load-bearing system according to claim 7, wherein the slots are aligned horizontally, vertically or diagonally with respect to an orientation of the load-bearing system.

10. The load-bearing system according to claim 2, wherein the slots are aligned horizontally, vertically or diagonally with respect to an orientation of the load-bearing system.

11. The load-bearing system according to claim 1, wherein the system is a personal load-bearing system, in which the web is of a form that is capable of being worn or carried on a body of a person.

12. The load-bearing system according to claim 11, wherein the apertures are preformed during a manufacture of the web.

13. The load-bearing system according to claim 1, wherein the apertures have substantially stable dimensions and shape.

14. The load-bearing system according to claim 1, wherein the apertures have reinforced edges.

15. The load-bearing system according to claim 1, wherein the attachment arrangement is an elongate clip including a strip that is at least one of preformed or foldable to define two generally parallel overlaid arms that are integrally joined at one end, and wherein the arms have a fastener arrangement which is configured to disengageably link the arms at or adjacent another end.

16. The load-bearing system according to claim 15, wherein, in situ, the fastener arrangement is capable of traversing the respective pairs of apertures in the arrays of apertures in the web and the pouch so as to form the closed loop.

17. The load-bearing system according to claim 16, wherein the fastener arrangement is a snap-fastener.

18. The load-bearing system according to claim 15, wherein the fastener arrangement is capable of being disengaged using a tool.

19. The load-bearing system according to claim 1, wherein at least one of the pouches includes:

a pouch body, and a backing panel attached to a rear section of the pouch body, wherein the backing panel includes an array of elongated slots comprising the apertures in the second array that form one or more pairs of slots which define the respective positions.

20. The load-bearing system according to claim 19, wherein at least one of the pairs of slots comprises a pair of parallel slots.

21. A load-bearing component for a load-bearing system, comprising:

a web of open-weave mesh for enhancing ventilation having a sufficient strength so as to support predetermined loads suspended there-from; and an array of apertures through the open-weave mesh in addition to holes in the open-weave mesh, wherein at least some of the apertures are elongated slots, and the slots form plural pairs of slots which define respective positions, and wherein at each of the positions, a pouch is capable of being attached to the web via an attachment arrangement which forms a closed loop through the respective pairs of horizontally matched and aligned slots comprising a said pair of slots in the web and further slots in the pouch.

22. The load-bearing component according to claim 21, wherein the system is a personal load-bearing system, in which the web is of a form that is capable of being worn or carried on a body of a person.

23. The load-bearing component according to claim 22, wherein the web has a form of a garment.

24. The load-bearing component according to claim 23, wherein the garment is a vest.

25. The load-bearing component according to claim 22, wherein the apertures are preformed during a manufacture of the web.

26. The load-bearing component according to claim 21, wherein the array of apertures includes one or more subsets of parallel elongated slots.

27. The load-bearing component according to claim 26, wherein the parallel elongated slots include slots that are aligned or co-linear.

28. The load-bearing component according to claim 26, wherein the slots are aligned horizontally, vertically or diagonally with respect to an orientation of the load-bearing component.

29. The load-bearing component according to claim 21, wherein the slots are aligned horizontally, vertically or diagonally with respect to an orientation of the load-bearing component.

30. The load-bearing component according to claim 21, wherein the apertures have substantially stable dimensions and shape.

31. The load-bearing component according to claim 21, wherein the apertures have reinforced edges.

32. A load-bearing system comprising:

a web of a fabric selected for enhancing ventilation having a sufficient strength so as to support at least one predetermined load suspended therefrom;

a first array of apertures provided through the fabric in addition to any ventilation holes therethrough;

a plurality of pouches having respective second arrays of apertures in rear faces thereof; and an attachment arrangement configured to attach each of the pouches to the web at one or more positions, wherein at each of the positions, the rear face of the pouch is positioned against the web of fabric so as to horizontally match and align respective pairs of the apertures in the first array and in the respective second array, and the attachment arrangement forms a closed loop through the respective pairs of apertures.

33. The load-bearing system according to claim 32, wherein the apertures are slots.

34. The load-bearing system according to claim 33, wherein the system is a personal load-bearing system, in which the web is of a form that is capable of being worn or carried on a body of a person.

35. The load-bearing system according to claim 32, wherein the system is a personal load-bearing system, in which the web is of a form that is capable of being worn or carried on a body of a person.

36. The load-bearing system according to claim 32, wherein the array of apertures includes one or more subsets of parallel elongated slots.

37. The load-bearing system according to claim 36, wherein the parallel elongated slots include slots that are aligned or co-linear.

38. The load-bearing system according to claim 32, wherein the apertures have reinforced edges.

39. The load-bearing system according to claim 32, wherein the attachment arrangement is an elongate clip including a strip that is at least one of preformed or foldable to define two generally parallel overlaid arms that are integrally joined at one end, and wherein the arms have a fastener arrangement which is configured to disengageably link the arms at or adjacent another end.

40. A load-bearing component for a load-bearing system, comprising:

a web of fabric selected for enhancing ventilation having a sufficient strength so as to support predetermined loads suspended therefrom; and an array of apertures through the fabric in addition to any ventilation holes therethrough, wherein at least some of the apertures are elongated slots, and the slots form plural pairs of slots which define respective positions, and wherein at each of the positions, a pouch is capable of being attached to the web via an attachment arrangement which forms a closed loop through the respective pairs of horizontally matched and aligned slots comprising a said pair of slots in the web and further slots in the pouch.

41. The load-bearing system according to claim 40, wherein the system is a personal load-bearing system, in which the web is of a form that is capable of being worn or carried on a body of a person.

42. The load-bearing system according to claim 40, wherein the array of apertures includes one or more subsets of parallel elongated slots.

43. The load-bearing system according to claim 42, wherein the parallel elongated slots include slots that are aligned or co-linear.

44. The load-bearing system according to claim 40, wherein the apertures have reinforced edges.

45. The load-bearing system according to claim 40, wherein the pouches includes:

wherein at least one of the pouches includes:

a pouch body, and a backing panel attached to a rear section of the pouch body, wherein the backing panel includes an array of elongated slots comprising the apertures in the second array that form one or more pairs of slots which define the respective positions.

46. The load-bearing system according to claim 45, wherein at least one of the pairs of slots comprises a pair of parallel slots.

* * * * *